United States Patent [19]

Courvoisier

[11] 4,012,057

[45] Mar. 15, 1977

[54] SKI BRAKE

[75] Inventor: Guy Courvoisier, Geneva, Switzerland

[73] Assignee: Battelle Memorial Institute, Carouge-Geneva, Switzerland

[22] Filed: Feb. 4, 1976

[21] Appl. No.: 655,265

[30] Foreign Application Priority Data

Feb. 6, 1975 Switzerland ..... 001469/75

[52] U.S. Cl. ..... 280/605

[51] Int. Cl.[2] ..... A63C 7/10

[58] Field of Search ..... 280/605, 604

[56] References Cited

UNITED STATES PATENTS

| | | | |
|---|---|---|---|
| 3,083,028 | 3/1963 | Miller | 280/605 |
| 3,741,575 | 6/1973 | Bortoli | 280/605 |
| 3,873,108 | 3/1975 | Lacarrau et al. | 280/604 |
| 3,884,487 | 5/1975 | Wehrli | 280/605 |

FOREIGN PATENTS OR APPLICATIONS

| | | | |
|---|---|---|---|
| 984,272 | 2/1951 | France | 280/605 |
| 412,700 | 2/1946 | Italy | 280/605 |
| 60,417 | 1/1939 | Norway | 280/605 |
| 71,225 | 10/1946 | Norway | 280/605 |

*Primary Examiner*—Joseph F. Peters, Jr.
*Assistant Examiner*—Milton L. Smith
*Attorney, Agent, or Firm*—Karl F. Ross; Herbert Dubno

[57] ABSTRACT

To arrest a ski runner upon its release from the skier's boot, two spurs are pivoted to a lateral face of the runner and are coupled together for joint rotation in opposite directions. A treadle rigid with or otherwise secured to one or both spurs overlies the upper runner surface in the region of the skier's boot so as to be depressed onto that surface when the boot is tied to the runner, thereby elevating the spurs into an aligned position alongside the runner against a spring force which may be that of an elastic part of the treadle. Upon detachment of the boot from the runner, the spring force swings the spurs downwardly and toward each other whereby their points bite into the snow at opposite angles. The pair of spurs may be duplicated on opposite sides of the runner for increased effectiveness.

12 Claims, 12 Drawing Figures

SKI BRAKE

FIELD OF THE INVENTION

My present invention relates to a ski brake designed to arrest a ski runner upon its detachment from the boot of the skier, either by voluntary removal or by the automatic release of a safety binding in the case of an accident.

BACKGROUND OF THE INVENTION

If a runner is detached from a skier's boot on a slope, there is danger that it may slide downhill and get lost or perhaps hurt other persons. The use of safety straps, designed to limit the extent to which the runner can separate from the boot, eliminates this risk but may have serious consequences for the skier himself as the runner is constrained in the case of a spill to follow the fallen skier, thus possibly injuring him.

It has therefore already been proposed to equip each ski runner with a self-activating brake designed to bite into the snow upon its release from the boot, the brake including a mobile element which is pivoted to the runner and in use is retracted above the lower surface of the latter but projects downwardly beyond that surface as soon as the boot is detached. Conventional devices of this nature, however, are only limitedly effective, depending on such factors as the quality of the snow, the steepness of the slope and the relative orientation of the runner and the slope at the instant of detachment. Thus, a ski brake designed to prevent forward sliding may be totally ineffective in the backward direction.

OBJECT OF THE INVENTION

The object of my present invention, therefore, is to provide an improved self-activating ski brake effective on all kinds of terrain in both forward and backward directions.

SUMMARY OF THE INVENTION

A brake according to my invention comprises a pair of spurs which are pivotally mounted on a lateral face of the runner, advantageously through the intermediary of a mounting plate, at longitudinally spaced locations. The two spurs are interconnected by coupling means, such as meshing gear teeth or a common hinge joint, for simultaneous rotation in opposite directions about axes transverse to the lateral runner face. A treadle extends from at least one of the spurs above the upper runner surface so as to be depressible by a skier's boot, secured to the runner via a releasable binding, for maintaining the spurs in a retracting position of substantial mutual alignment alongside the runner face on which they are mounted. A force tending to swing the spurs from their retracted position into a working position, in which they diverge downwardly so as to have lower extremities projecting below the lower runner surface while pointing in opposite directions, is exerted upon the spurs by biasing means which may include a resilient portion of the treadle itself.

A brake of this description may be duplicated on opposite lateral faces of the runner, with separate treadles or a common treadle to be depressed by the boot.

BRIEF DESCRIPTION OF THE DRAWING

The above and other features of my invention will now be described in detail with reference to the accompanying drawing in which.

SPECIFIC DESCRIPTION

Figure 1:
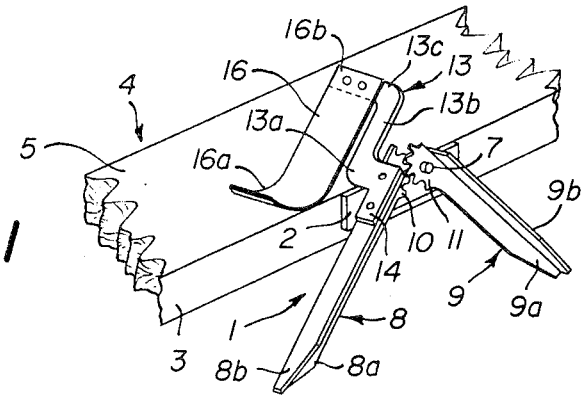
FIG. 1 is a perspective view of part of a ski runner equipped with a brake according to my invention.
Figure 2:
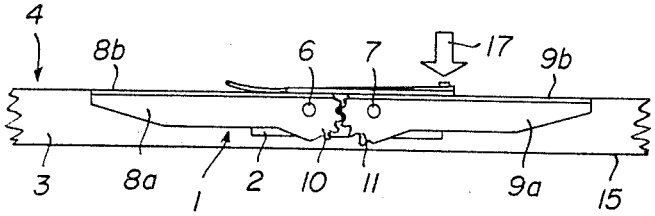
FIG. 2 is a side-elevational view of the brake of FIG. 1, shown in retracted position.
Figure 3:
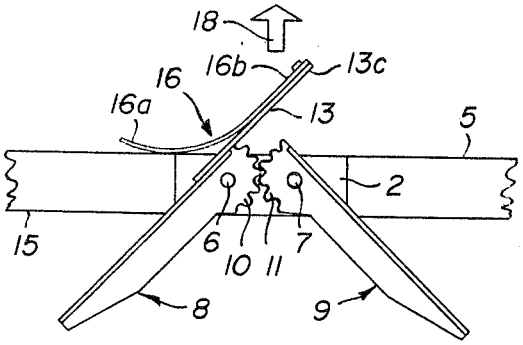
FIG. 3 is a view similar to FIG. 2, showing the brake in working position.

The assembly shown in FIGs. 1 – 3 comprises a ski runner 4, illustrated only in part, equipped with a brake 1 according to my invention. This brake comprises a mounting plate 2 screwed or otherwise secured to a lateral face 3 of the runner 4, terminating about flush with the upper runner surface 5 at the location where the skier's boot comes to rest on that upper surface when secured to the runner by a conventional safety binding not shown. Plate 2 carries two transverse pins 6 and 7 serving as pivots for a pair of swingable spurs 8, 9 in the form of two substantially identical, symmetrical angle profiles, each profile consisting of two mutually perpendicular flanges 8*a*, 8*b*, 9*a*, 9*b* with beveled extremities forming a pointed tip designed to bite into the snow in their downwardly diverging working position of FIGS. 1 and 3. The opposite ends of spurs 8 and 9 form two meshing gear sectors 10 and 11 centered on pivot pins 6 and 7, respectively; the spacing of these pins in the longitudinal direction of the runner, corresponding to twice the sector radius, is roughly equal to the thickness of the runner.

An extension 13 of spur 8, secured to it by an integral leg 14, is a generally S-shaped arm in the plane of flange 8*b* with two elbows 13*a*, 13*c* and an intervening section 13*b*. Elbow 13*c*, remote from spur 8, overlies the upper runner surface 5 and is secured to an end 16*b* of an arched leaf spring 16 bearing with its other end 16*a* on surface 5.

In the position of FIG. 2, in which a nonillustrated boot tied to the runner 4 exerts pressure upon the treadle consisting of arm 13 and spring 16, the spring is flattened against surface 5 and the spurs 8, 9 are aligned with each other so that their beveled extremities are retracted above the lower runner surface 15. The spurs, therefore, do not exert any braking effect and the runner may be used normally by the skier.

When the boot is detached, as indicated in FIG. 3 by an arrow 18, spring 16 raises the arm 13 off the upper runner surface 5 whereby the two spurs 8 and 9 are swung counterclockwise and clockwise, respectively, to become effective as a two-way brake. Thus, the runner will be held against both forward and backward sliding.

Figure 4:
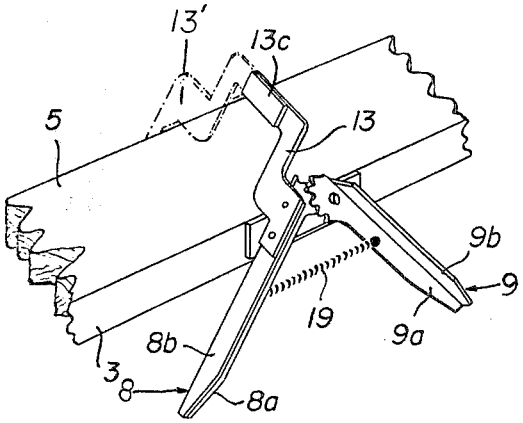
FIG. 4 is a view similar to FIG. 1, illustrating a modification.
Figure 5:
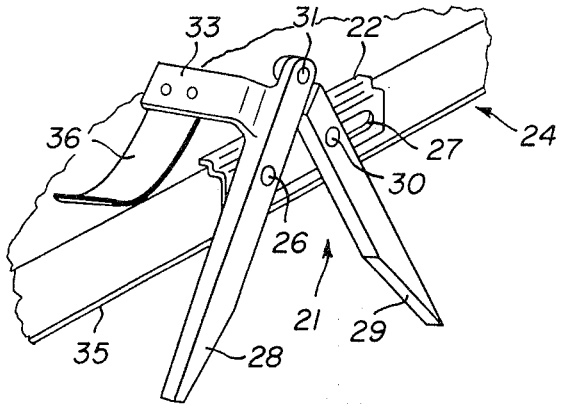
FIG. 5 is a view similar to FIGS. 1 and 4, showing another embodiment.
Figure 6:
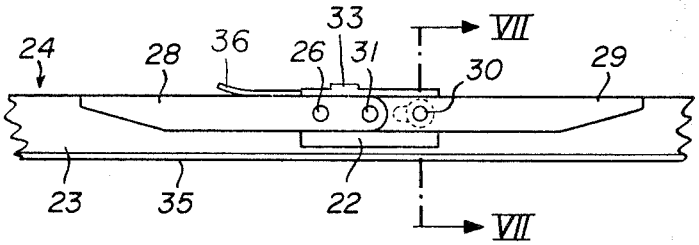
FIG. 6 is a view similar to FIG. 2, showing the brake of FIG. 5 in retracted position.
Figure 7:
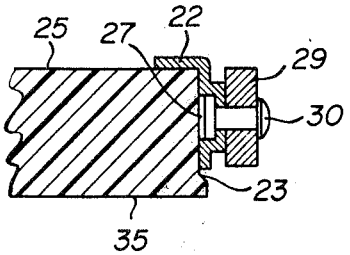
FIG. 7 is a sectional detail view taken on the line VII — VII of FIG. 6.
Figure 8:
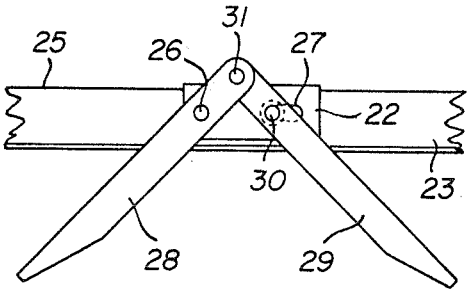
FIG. 8 is a view similar to FIG. 3, showing the brake of FIG. 5 in working position.
Figure 9:
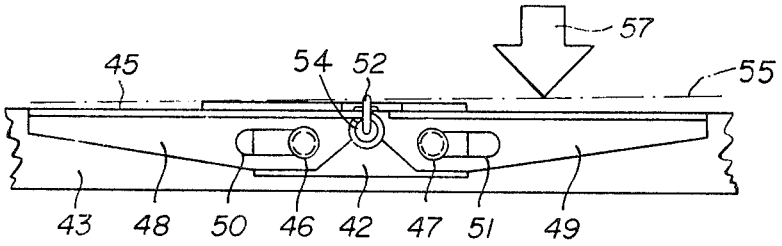
FIG. 9 is a view similar to FIGS. 2 and 6, illustrating a further embodiment with the brake shown in retracted position.
Figure 10:
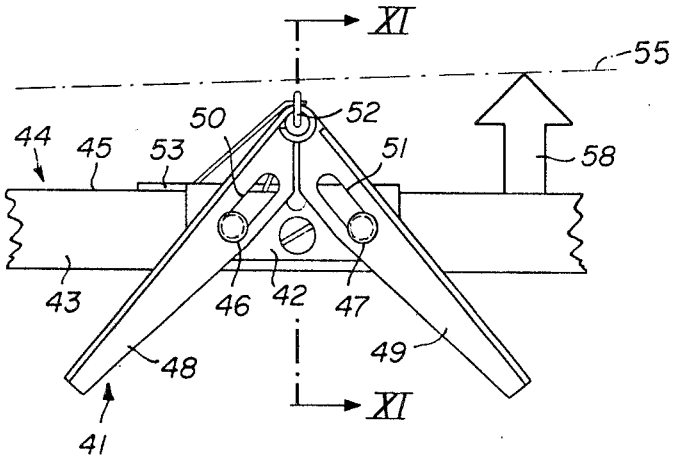
FIG. 10 is a view similar to FIGS. 3 and 8, showing the brake of FIG. 9 in working position.
Figure 11:
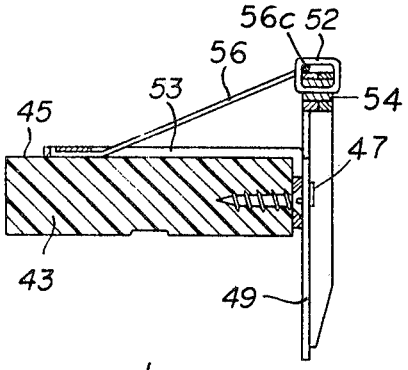
FIG. 11 is a sectional detail view taken on the line XI — XI of FIG. 10.

As illustrated in FIG. 4, the leaf spring 16 may be replaced by a coil spring 19 anchored under tension to the flanges 8*a* and 9*a* of spurs 8 and 9, at points which lie below the swing axes (pins 6 and 7) in the retracted position of FIG. 2. In FIG. 4 I have also illustrated, in dot-dash lines, a second arm 13' integral with arm 13, this arm 13' forming part of an identical second brake mounted on the lateral runner face opposite face 3. The presence of two such brakes not only increases the effectiveness of the device according to my invention but also insures that a runner that happens to be standing on edge will be prevented from sliding downhill, the spurs at that edge being forced into the snow by the weight of the runner. The angular profile of the spurs and their beveled extremities insure in each instant a maximum braking action.

It should be noted that the spring 16 or 19 need not be particularly strong inasmuch as the movement of the runner over the snow will tend to continue the swing of the spurs into their working position as soon as their tips begin to make contact with the snow.

Naturally, the duplication of the brake illustrated in FIG. 4 can also be realized with the construction shown in FIGS. 1 – 3.

In FIGS. 5 – 8 I have shown a runner 24 equipped with a modified brake 21 whose construction is generally similar to that of brake 1 in the preceding Figures and which obviously could also be duplicated on opposite sides of the runner. A stepped mounting plate 22 fixedly supports a pivot pin 26 and has a slot 27, extending longitudinally of the runner at the level of pin 26, in which another pivot pin 30 is slidable. The pins 26 and 30 form the fulcra of two spurs 28, 29 which are here shown as flat bars but which could also have an angle profile similar to that of spurs 8 and 9 of FIGS. 1 – 4. Plate 22 adjoins a recessed lateral runner face 23 and also overlies an adjoining part of the upper runner surface 25.

The upper ends of spurs 28 and 29 (as seen in the working position of the brake) are articulated to each other by a hinge pin 31 insuring their counterrotation. An arm 33, integral with spur 38, forms part of a treadle also including a leaf spring 36 which is generally similar to spring 16 of FIGS. 1 – 3 and again tends to swing the two spurs into their working position illustrated in FIGS. 5 and 8. In that working position, the lower extremities of the spurs project beyond the undersurface 35 of the runner 24 to exert a braking action in a manner analogous to that described above.

The embodiment of FIGS. 9 – 12 comprises a brake 41 with a mounting plate 42 secured to a lateral face 43 of a runner 44. An arm 53 integral with plate 42 rests flat on the upper runner surface 45 and has an elbow 53*a* which forms an anchorage for the ends 56*a*, 56*b* of a hairpin spring 56. The bight portion 56*c* of spring 56 passes through a wire loop 52 which traverses a hinge pin 54 serving to interlink two spurs 48 and 49, these spurs being formed with longitudinal slots 50 and 51 accommodating respective pivot pins 46 and 47 rigid with mounting plate 42.

The operation of brake 41 is analogous to that described above for brakes 1 and 21. Thus, when the sole of the boot diagrammatically indicated at 55 comes to rest on the spring 56, acting as a treadle, that spring is flattened against the upper runner surface 45 and the spurs 48, 49 are withdrawn into a retracted position of FIG. 9 where the pressure of the boot has been indicated by an arrow 57. An arrow 58, FIG. 10, indicates the lifting of the boot 55 off the runner 44 whereupon spring 56 swings the spurs 48 and 49 into their working position.

Figure 12:
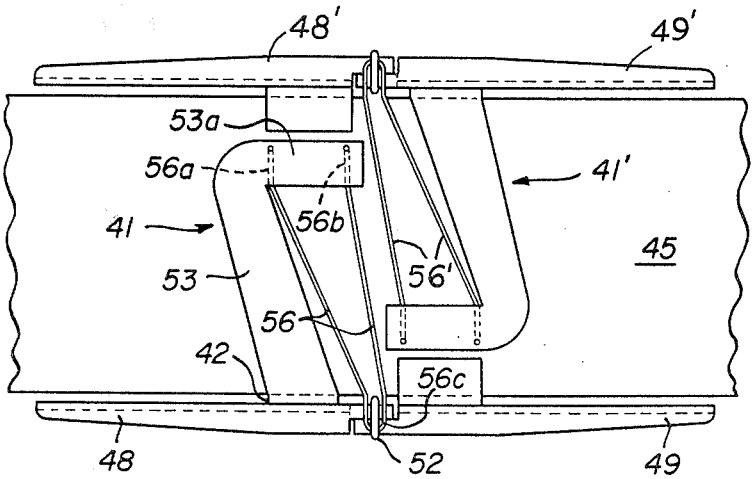
FIG. 12 is a top view of a runner equipped with two brakes of the type shown in FIGS. 9 to 11.

As shown in FIG. 12, an identical brake 41' is secured to the opposite side face of the runner in symmetrical relationship with brake 41, its spurs 48' and 49' being held retracted under the control of a hairpin spring 56' as long as the boot rests on surface 45. Here, too, the springs 56, 56' of the two brakes could be combined into a single spring acting as a common pedal therefor.

In a two-brake system such as the one illustrated in FIG. 12, the four spurs 48, 48'', 49, 49' would tend to lift the unloaded runner off the ground if the latter is covered by ice or hard snow. Thus, the sole of the runner would have no contact with the ground surface in this case, at least over a substantial part of its length, whereby the weight of the runner would help drive the pointed tips of the spurs into the frozen ground covering.

It will be apparent that the simple construction of my improved ski brake allows it to be mass-produced, rapidly and effeciently, from prefabricated modular units. The operation of conventional ski bindings will not be affected by the presence of these devices.

I claim:

1. A self-arresting ski including a runner and a brake operative upon removal of a skier's boot from an upper surface of said runner, said brake comprising:

a pair of spurs pivotally mounted on a lateral face of said runner at longitudinally spaced locations;

coupling means interconnecting said spurs for joint rotation in opposite directions about axes transverse to said lateral face;

treadle means extending from at least one of said spurs above the upper surface of said runner for depression by a skier's boot secured to the runner, said treadle means upon such depression maintaining said spurs in a retracted position of substantial mutual alignment alongside said lateral face; and biasing means for exerting upon said spurs a force tending to swing said spurs from said retracted position into a working position in which said spurs diverge downwardly with lower extremities projecting beyond a lower surface of said runner while pointing in opposite directions.

2. A ski as defined in claim 1 wherein said biasing means comprises a resilient portion of said treadle means.

3. A ski as defined in claim 2 wherein said treadle means comprises a rigid extension of one of said spurs, said resilient portion being a leaf spring secured to said extension and bearing upon said upper surface.

4. A ski as defined in claim 2 wherein said spurs have hingedly interconnected upper ends, said resilient portion comprising a hairpin spring having a bight portion linked with said interconnected ends.

5. A ski as defined in claim 1, further comprising a mounting plate for said spurs fixed to said lateral face, said spurs being provided with a pair of parallel pivot pins engaging said mounting plate.

6. A ski as defined in claim 5 wherein said spurs have upper ends provided with meshing sets of gear teeth respectively centered on said pins.

7. A ski as defined in claim 5 wherein said spurs have hingedly interconnected upper ends, one of said pins being fixed to said mounting plate, the other of said pins being received in a slot of said mounting plate extending longitudinally of said runner.

8. A ski as defined in claim 5 wherein said spurs have hingedly interconnected upper ends, said pins being fixed to said mounting plate, said spurs being provided with longitudinal slots receiving said pins.

9. A ski as defined in claim 1 wherein said brake is substantially symmetrically duplicated on opposite lateral faces of said runner.

10. A ski as defined in claim 9 wherein said treadle means is common to the two brakes on said opposite lateral faces.

11. A ski as defined in claim 1 wherein said spurs are angle profiles.

12. A ski as defined in claim 11 wherein said angle profiles consist of two mutually perpendicular flanges beveled at said lower extremities to form a pointed tip.

* * * * *